US008444828B2

(12) United States Patent
Wolfe

(10) Patent No.: US 8,444,828 B2
(45) Date of Patent: May 21, 2013

(54) PYROLYZER FURNACE APPARATUS AND METHOD FOR OPERATION THEREOF

(75) Inventor: Richard A. Wolfe, Banner Elk, NC (US)

(73) Assignee: Nucor Corporation, Charlotte, NC (US)

( * ) Notice: Subject to any disclaimer, the term of this patent is extended or adjusted under 35 U.S.C. 154(b) by 906 days.

(21) Appl. No.: 11/959,581

(22) Filed: Dec. 19, 2007

(65) Prior Publication Data

US 2008/0149471 A1 Jun. 26, 2008

Related U.S. Application Data

(60) Provisional application No. 60/871,863, filed on Dec. 26, 2006.

(51) Int. Cl.
*C10B 47/44* (2006.01)

(52) U.S. Cl.
USPC ..... 201/15; 201/32; 202/118

(58) Field of Classification Search
USPC ..... 201/14, 15, 27, 32, 33; 202/117, 202/118, 270; 110/257; 432/114; 165/87, 165/88, 179, 183
See application file for complete search history.

(56) References Cited

U.S. PATENT DOCUMENTS

| | | | | |
|---|---|---|---|---|
| 1,276,428 A | | 8/1918 | Smith | |
| 1,415,061 A | * | 5/1922 | Smith et al. | 202/118 |
| 1,468,379 A | | 9/1923 | Easton | |
| 1,481,627 A | | 1/1924 | Smith | |
| 1,595,933 A | | 8/1926 | Hayes | |
| 1,595,934 A | | 8/1926 | Hayes | |
| 1,662,575 A | | 3/1928 | Hayes | |
| 1,669,023 A | | 5/1928 | Runge | |
| 1,669,024 A | | 5/1928 | Runge | |
| 1,713,840 A | * | 5/1929 | Laucks | 201/33 |
| 1,723,932 A | | 8/1929 | Greene et al. | |
| 1,751,127 A | | 3/1930 | Cantieny | |
| 1,770,636 A | * | 7/1930 | Von Radolin | 202/218 |
| 1,771,999 A | | 8/1930 | Greene et al. | |

(Continued)

FOREIGN PATENT DOCUMENTS

| | | |
|---|---|---|
| CA | 579100 | 7/1959 |
| CA | 1118207 | 2/1982 |

(Continued)

OTHER PUBLICATIONS

Wolfe, Richard A., Briefing Package on ICH-Wolfe Technololgy to Produce a High Carbon Char Product from Bituminous Coal, Jul. 12, 2005.

*Primary Examiner* — Jill Warden
*Assistant Examiner* — Joye L Woodard
(74) *Attorney, Agent, or Firm* — Hahn Loeser & Parks LLP

(57) ABSTRACT

A pyrolyzer and method is provided for devolatizing coal and other volatile materials. The pyrolyzer has a pyrolyzer furnace housing having at least two screws laterally positioned adjacent and overlapping rotatably mounted within the furnace for moving volatile material through the pyrolyzer furnace housing. The screws have hollow drive shafts with a diverter inside for converging heated fluid to heat the volatile material moving through the pyrolyzer furnace housing. A combustion chamber combusts fuel to create heated exhaust gas for directing through the hollow drive shafts to heat the volatile material. The pyrolyzer furnace housing may have a double wall with a cavity between, capable of receiving heated fluid for further heating of volatile material moving through the pyrolyzer furnace housing.

24 Claims, 16 Drawing Sheets

U.S. PATENT DOCUMENTS

| | | | | | |
|---|---|---|---|---|---|
| 1,775,323 | A | | 9/1930 | Runge | |
| 1,783,982 | A | | 12/1930 | Runge et al. | |
| 1,797,796 | A | | 3/1931 | Runge | |
| 1,805,109 | A | | 5/1931 | Runge et al. | |
| 1,810,828 | A | | 6/1931 | Hayes | |
| 1,881,826 | A | | 10/1932 | McQuade | |
| 1,921,993 | A | | 8/1933 | McQuade | |
| 1,923,209 | A | | 8/1933 | Illingsworth | |
| 1,972,929 | A | | 9/1934 | Fisher | |
| 2,287,437 | A | | 6/1942 | Lesher et al. | |
| 2,357,621 | A | * | 9/1944 | Tuttle | 202/118 |
| 2,638,889 | A | * | 5/1953 | Dow | 126/91 A |
| 2,998,375 | A | | 8/1961 | Peterson et al. | |
| 3,023,456 | A | | 3/1962 | Palfey | |
| 3,051,629 | A | | 8/1962 | Gorin et al. | |
| 3,082,816 | A | | 3/1963 | Skidmore | |
| 3,177,128 | A | | 4/1965 | Vartanian | |
| 3,178,361 | A | | 4/1965 | Bailey | |
| 3,184,293 | A | | 5/1965 | Work et al. | |
| 3,251,751 | A | | 5/1966 | Lindahl et al. | |
| 3,401,089 | A | | 9/1968 | Friedrich et al. | |
| 3,525,124 | A | | 8/1970 | Ocker | |
| 3,548,926 | A | * | 12/1970 | Archer | 165/87 |
| 3,658,654 | A | | 4/1972 | Gutberlet | |
| 3,787,292 | A | | 1/1974 | Keappler | |
| 3,976,548 | A | | 8/1976 | Kevorkian et al. | |
| 4,077,868 | A | | 3/1978 | Chambers | |
| 4,084,521 | A | | 4/1978 | Herbold et al. | |
| 4,094,746 | A | | 6/1978 | Masciantonio et al. | |
| 4,094,769 | A | | 6/1978 | Brown | |
| 4,098,649 | A | | 7/1978 | Redker | |
| 4,106,997 | A | | 8/1978 | Kevorkian et al. | |
| 4,140,478 | A | | 2/1979 | Kawakami et al. | |
| 4,206,713 | A | | 6/1980 | Ryason | |
| 4,235,676 | A | | 11/1980 | Chambers | |
| 4,308,103 | A | | 12/1981 | Rotter | |
| 4,366,026 | A | | 12/1982 | Leyendecker | |
| 4,374,704 | A | * | 2/1983 | Young | 202/117 |
| 4,395,309 | A | | 7/1983 | Esztergar | |
| 4,398,471 | A | * | 8/1983 | Thomanetz | 110/235 |
| 4,399,906 | A | | 8/1983 | Millsap | |
| 4,439,306 | A | | 3/1984 | Voetter et al. | |
| 4,466,809 | A | | 8/1984 | Kissel et al. | |
| 4,483,257 | A | | 11/1984 | den Otter | |
| 4,583,995 | A | | 4/1986 | Winckler et al. | |
| 4,584,060 | A | | 4/1986 | Winckler et al. | |
| 4,671,800 | A | | 6/1987 | Meyer et al. | |
| 4,686,008 | A | | 8/1987 | Gibson | |
| 4,704,134 | A | | 11/1987 | Meyer et al. | |
| 4,705,603 | A | | 11/1987 | McMullen et al. | |
| 4,844,153 | A | * | 7/1989 | Mellsjo | 165/174 |
| 4,908,104 | A | | 3/1990 | Loomans et al. | |
| 5,017,269 | A | | 5/1991 | Loomans et al. | |
| 5,057,189 | A | | 10/1991 | Apffel | |
| 5,082,534 | A | | 1/1992 | Breu | |
| 5,151,159 | A | | 9/1992 | Wolfe et al. | |
| 5,227,026 | A | | 7/1993 | Hogan | |
| 5,296,005 | A | | 3/1994 | Wolfe et al. | |
| 5,417,492 | A | | 5/1995 | Christian et al. | |
| 5,697,168 | A | | 12/1997 | Matthys et al. | |
| 5,944,960 | A | | 8/1999 | Nakata et al. | |
| 6,675,746 | B2 | * | 1/2004 | Gerstmann et al. | 122/367.1 |
| 6,972,085 | B1 | | 12/2005 | Brecher et al. | |
| 7,594,978 | B2 | | 9/2009 | Brecher et al. | |
| 2003/0051987 | A1 | | 3/2003 | Owen | |
| 2008/0053347 | A1 | * | 3/2008 | Walker et al. | 110/257 |

FOREIGN PATENT DOCUMENTS

| | | |
|---|---|---|
| DE | 2728661 | 12/1997 |
| GB | 427849 | 5/1935 |
| GB | 539193 | 9/1941 |
| GB | 541314 | 11/1941 |
| GB | 545473 | 5/1942 |
| GB | 793517 | 4/1958 |
| GB | 151600 | 6/1978 |

* cited by examiner

PYROLYZER FURNACE APPARATUS AND METHOD FOR OPERATION THEREOF

This application claims the benefit of U.S. Provisional Patent Application 60/871,863 filed Dec. 26, 2006, incorporated herein by reference in its entirety.

BACKGROUND AND SUMMARY OF THE DISCLOSURE

The present invention relates to processing methods and apparatus for converting coal or other carbon-bearing materials into char. Char can be produced by heating coal or other carbon-bearing materials to selected temperatures in a reduced-oxygen environment. Char having suitable properties may be used in, among other things, iron and steel processing furnaces.

Heating coal or other carbon-bearing materials in a reduced-oxygen environment produces coal gas, volatile liquids and a residue of char. During the process of making char, volatile materials, such as hydrocarbon fuels, in the carbon-bearing materials fluidize when heated to a temperature of approximately 650° F. (approximately 350° C.) and higher.

A pyrolyzer furnace is one apparatus that may be used for processing coal and other hydrocarbon materials into char. A pyrolyzer can operate in a batch or in a continuous process. In one continuous pyrolyzer, one or more drive screws rotate within the pyrolyzer furnace, wherein the coal is heated in a reduced-oxygen environment to a temperature to fluidize the volatile material as the carbon-bearing materials are moved through the furnace. An example of a continuous pyrolyzer furnace is disclosed in U.S. Pat. No. 5,151,159 to Wolfe, et al. Previous pyrolyzer furnaces disclosed by the prior art had heating elements positioned within the furnace housing, which generated hot spots within the furnace, caused uneven heating of the coal or other carbon-bearing material, and caused fatigue and shortened the life of the furnace components.

Another limitation has been the energy efficiency of previous pyrolyzer furnaces. The previous pyrolyzer furnaces were typically heated by electric heaters, or by burning natural gas, fuel oil or propane, to process the fluidized volatile material into hydrocarbon fuel and coal tar products. Pyrolyzer furnaces in the prior art also had drive screws with solid shafts, oil cooled shafts, and other shaft configurations that were thermally inefficient, resulting in the pyrolyzer furnace consuming more fuel.

What has been needed is a pyrolyzer furnace system, and method for making char in that system, that substantially reduces the external energy, e.g. propane, fuel oil, or natural gas, needed for the char making process. The level of additional energy may be reduced to a point that the char making process is sustained by burning only the fluidized volatile materials generated from char making after start up.

Disclosed is a char making apparatus comprising:

a. a longitudinal pyrolyzer furnace housing wherein carbon-bearing material containing volatile materials may be heated to a temperature to fluidize volatile materials therein;

b. at least two counter rotatable drive screws laterally positioned and overlapping within the longitudinal furnace housing, and capable of conveying carbon-bearing materials containing volatile material through the pyrolyzer furnace housing, each drive screw having a hollow drive shaft and a diverter longitudinally positioned within the drive shaft, the diverter forming with an inner surface of each drive shaft an inner passageway capable of directing heated fluid adjacent the carbon-bearing materials moving through the pyrolyzer furnace to fluidize the volatile material therein;

c. a combustion chamber capable of burning fluidized volatile material and, if desired, other hydrocarbon fuels, and exhausting combustion fluids through the inner passageway within the hollow drive shaft of the rotatable drive screws within the pyrolyzer furnace housing; and d. a conduit being capable of transferring fluidized volatile material from the pyrolyzer furnace to the combustion chamber to be burned.

Also disclosed is a method for making char, comprising the steps of:

a. assembling a longitudinal pyrolyzer furnace housing having at least two counter rotatable drive screws laterally positioned and overlapping within the longitudinal furnace housing, and capable of conveying carbon-bearing materials containing volatile material through the pyrolyzer furnace housing, each drive screw having a hollow drive shaft and a diverter longitudinally positioned within the drive shaft, the diverter forming with an inner surface of each drive shaft an inner passageway capable of directing heated fluid adjacent the carbon-bearing materials moving through the pyrolyzer furnace to fluidize the volatile material therein;

b. assembling a combustion chamber adjacent the longitudinal pyrolyzer furnace housing capable of burning fluidized volatile material and, if desired, other hydrocarbon fuels, and exhausting combustion fluids through the inner passageway within the hollow drive shaft of the drive screws within the pyrolyzer furnace housing; and c. counter rotating the screws to cause carbon-bearing material containing volatile materials to move through the longitudinal pyrolyzer furnace housing and be heated to a temperature to fluidize volatile materials therein.

The fluidized volatile material may be transferred from the pyrolyzer furnace to the combustion chamber, where the fluidized volatile material may be burned to provide some or all of the heat needed to fluidize volatile material in the pyrolyzer furnace. The char making furnace, and method of operation thereof, may be capable of heating volatile material in the carbon-bearing material to a temperature within the range of approximately 650° F. to 1300° F. The combustion fluids exhausted through the inner passageways may also flow in the same direction as the drive screws move the carbon-bearing material through the pyrolyzer furnace housing.

The pyrolyzer furnace may comprise a double outer wall at least partially around the drive screws and forming an outer passageway between the outer walls capable of conveying a flow of heated fluid adjacent the carbon-bearing material moving through the pyrolyzer furnace to fluidize the volatile material therein. A device, such as protrusions, tabs, ribs or other shapes, may provide a turbulent flow of combustion fluids through the inner passageway, and if present, the outer passageway, at a Reynolds number greater than 4000. Further, at least one manifold conduit may conduct heated fluid from the combustion chamber to selected portions of the outer passageway along the pyrolyzer furnace housing.

Alternately or in addition, at least one clearing screw having a smaller diameter may be positioned longitudinally through the furnace housing adjacent the drive screws, and capable of conveying carbon-bearing materials from the drive screws through the pyrolyzer furnace housing.

Also, the pyrolyzer furnace may have at least three drive screws laterally positioned within the pyrolyzer furnace housing, the drive screws being positioned such that each screw overlaps at least one other screw. If desired, more than one clearing screw may be positioned adjacent the drive screws and capable of conveying carbon-bearing materials from the drive screws through the pyrolyzer furnace housing.

A portion of the pyrolyzer furnace housing through which the carbon-bearing material moves may comprise a decreasing cross sectional area in the portion through which the carbon-bearing material moves in the direction of travel of the carbon-bearing material. To accomplish this, at least a portion of the pyrolyzer furnace housing may have a tapered outer wall in the direction of travel of the carbon-bearing material through the pyrolyzer furnace housing, and/or the outer wall of the hollow drive shaft of the drive screws may have a taper to reduce the cross sectional area in the direction of travel of the carbon-bearing material.

In addition, the pyrolyzer furnace may have a furnace housing comprising a first zone and a second zone. The first zone is capable of fluidizing volatile material in the carbon-bearing material. The second zone is capable of mixing supplemental materials, e.g. iron oxide-bearing material, with the carbon-bearing material, the supplemental material being introduced into the furnace housing in the second zone.

At least a portion of the pyrolyzer furnace housing may rotate around the drive screws.

DETAILED DESCRIPTION OF THE DISCLOSURE

Figure 1:
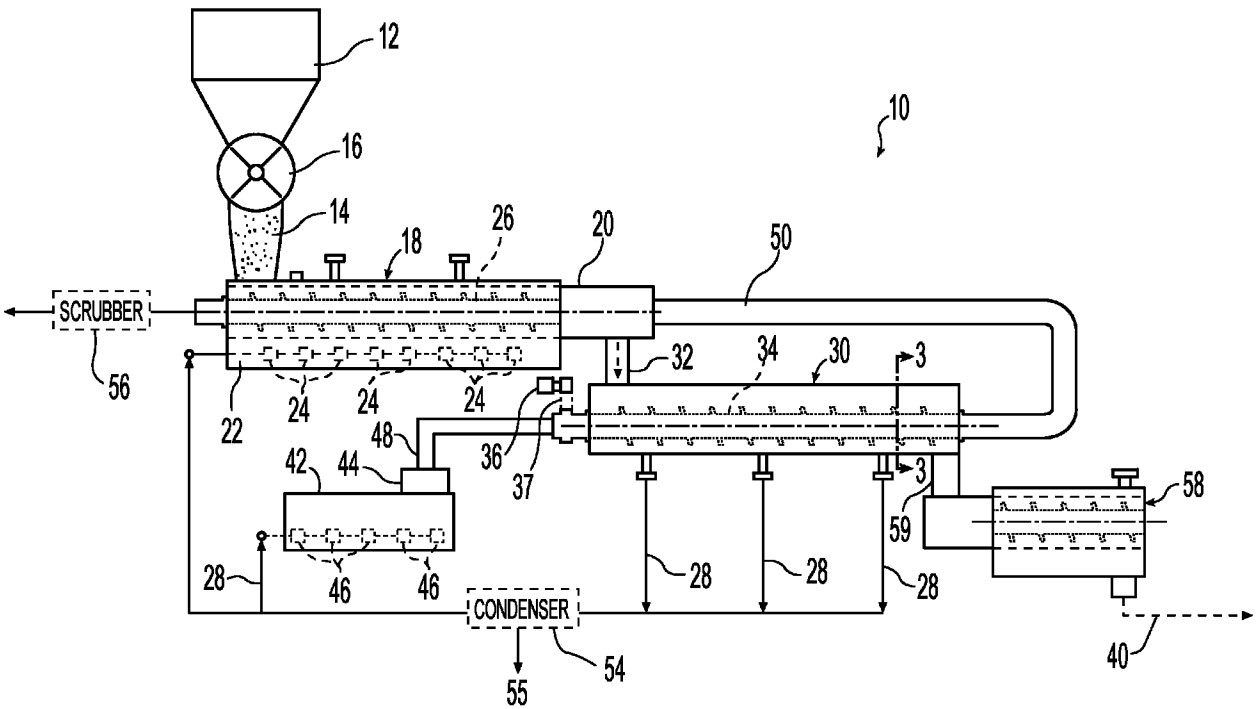
FIG. 1 is a system for making char.

Referring now to FIG. 1, a furnace system 10 is provided for making char. The furnace system 10 receives, as raw materials, carbon-bearing material having a predetermined size, and processes the carbonaceous material into an atmosphere containing little, if any, oxygen. In the furnace, the carbon-bearing material is dried and then heated to a temperature to fluidize the volatile materials in the carbon-bearing material.

The furnace system 10 comprises a receiving hopper 12 for containing coal particles 14, or particles of other carbon-bearing materials, of a predetermined size. The size of the coal particles 14 may be, for example, in a range of about ¼ inch to about −6 Tyler mesh (about 6.4 mm to about 3.3 mm). The coal particles 14 pass from the receiving hopper 12 through an airlock 16 and into a pre-dryer 18.

The pre-dryer 18 comprises a drying chamber 20 within a drying furnace 22 having a plurality of burners 24 mounted therein. The drying chamber 20 has a drive screw 26 rotatably mounted for conveying the coal particles 14, or other carbon-bearing materials, through the drying chamber 20. The temperature in the drying chamber 20 may be maintained at about 400° F. (approximately 200° C.) to release at least a portion of the water vapor incorporated within the coal particles 14. A portion of the volatile materials 28 in some carbon-bearing materials may begin to volatilize in the pre-dryer at about 400° F. (approximately 200° C.). The pre-dryer 18 may be maintained at a temperature of about 300° F. (approximately 150° C.) or lower to remove water vapor while fluidizing little or no volatile materials 28.

The pyrolyzer furnace 30, or retort furnace, may be hermetically connected to the pre-dryer 18 and receive the processed coal particles 14 from the pre-dryer by way of an airlock and screw feeder 32. Two drive screws 34 are laterally positioned adjacent each other in an overlapping array within a longitudinal furnace housing 31 of pyrolyzer furnace 30. Each drive screw 34 is rotatably mounted within the pyrolyzer furnace housing 31 for moving the coal or other carbon-bearing material therethrough. An electric or pneumatic motor 36 may be provided to drive the drive screws 34 through a drive train 37.

In one embodiment, the carbon-bearing materials passing through the pyrolyzer furnace 30 are heated by hot combustion fluids. In the embodiment of FIG. 1, a combustion chamber 42 comprises a blower 44 and a plurality of burners 46. A conduit 48 transfers combusted fluids from the combustion chamber 42 to the pyrolyzer furnace 30. The combustion chamber 42 is capable of burning fluidized volatile materials 28 and/or other hydrocarbon fuels (e.g. propane, natural gas, or fuel oil), and exhausting combustion fluids to the pyrolyzer furnace 30 by the blower 44 through the conduit 48.

As shown in FIG. 1, the hot combustion fluids flow through the pyrolyzer furnace 30 and then into a dryer conduit 50. The hot combustion fluids may enter the pyrolyzer furnace 30 at a temperature of about 1600 to 1700° F. (about 870 to 930° C.), and may leave the pyrolyzer furnace 30 through dryer conduit 50 at a temperature of about 400 to 500° F. (about 200 to 260° C.). The combustion fluids move through the dryer conduit 50 to the pre-dryer 18. The combustion fluids may pass through the pre-dryer 18 to dry and preheat the carbon-bearing material, and may be exhausted at a temperature of about 100° F. (about 38° C.). If desired, a scrubber 56 may receive the exhausted fluids after heating the pre-dryer 18 to further separate sulfur and other impurities before being exhausted to the environment.

The pyrolyzer furnace 30 is heated to a temperature to fluidize and release the volatile materials 28 contained within the carbon-bearing material, including hydrocarbon fuels, and water vapor from the coal particles 14. The fluidized volatile material 28 may comprise hydrogen and methane. Suitable piping or other conduit may operate to transfer the fluidized volatile materials 28 from the pyrolyzer furnace 30 to the combustion chamber 42 and the pre-dryer 18, if desired, to fuel the burners 24 in pre-dryer 18 and burners 46 in the combustion chamber 42.

As shown in FIG. 1, a condenser 54 may optionally be provided in communication with the pyrolyzer furnace 30 to separate liquids from the fluidized volatile materials 28. If desired, the condenser 54 may be used to separate coal tar liquids 55 and water from gaseous coal fluids using known methods and apparatus. Coal tar liquids may be collected for sale as a commodity, or may be transferred to the burners 24 in the pre-dryer 18 and the burners 46 in the combustion chamber 42 to be burned as fuel.

The longitudinal furnace housing 31 of the pyrolyzer furnace 30 houses a portion where carbon-bearing material containing volatile materials may be heated to a temperature to fluidize volatile materials therein. The drive screws 34 are rotatably positioned within and along the length of the longitudinal furnace housing 31. The drive screws 34 are counter-rotated to move coal or other carbon-bearing material through the furnace housing 31, and discharge devolatilized coal residue, char 40, from the pyrolyzer furnace 30. Char 40 from the pyrolyzer furnace 30 may be transferred to a char cooler 58, which may be hermetically connected to the pyrolyzer furnace 30 by way of an airlock and screw feeder 59. In one embodiment, the char cooler 58 cools the char 40 to a temperature below that which the char would ignite if exposed to air.

Figure 3:
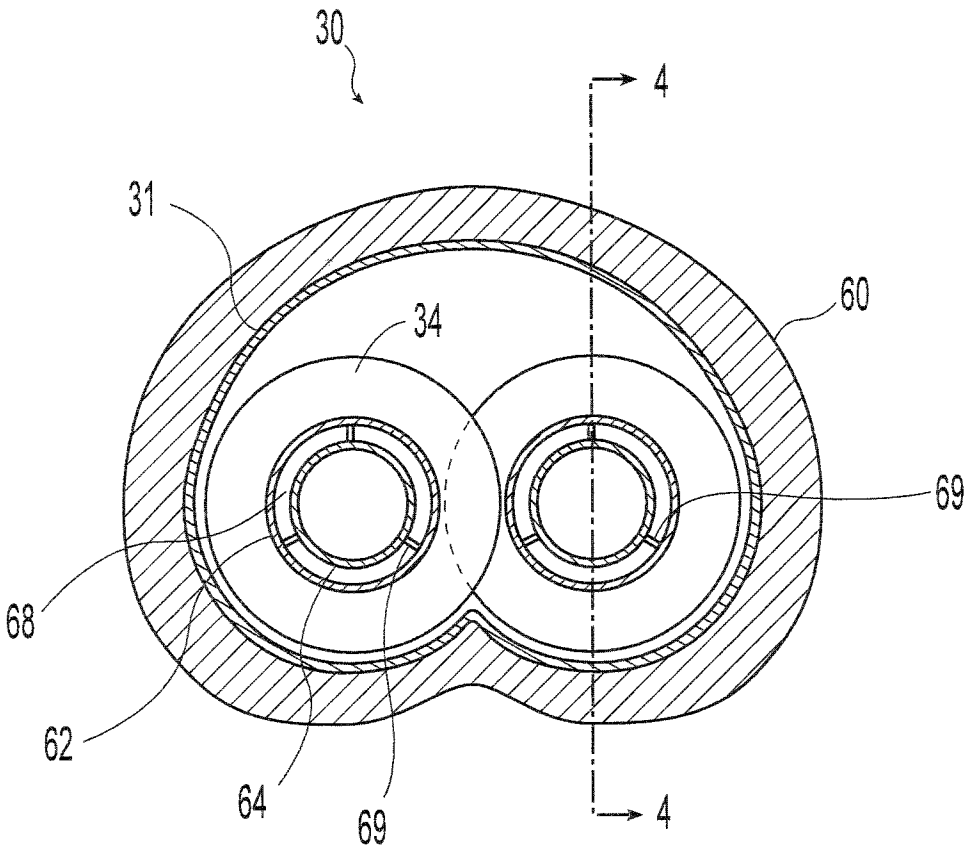
FIG. 3 is a cross sectional view through a pyrolyzer of the present disclosure through the section marked 3-3 in FIG. 1 or FIG. 2.
Figure 4:
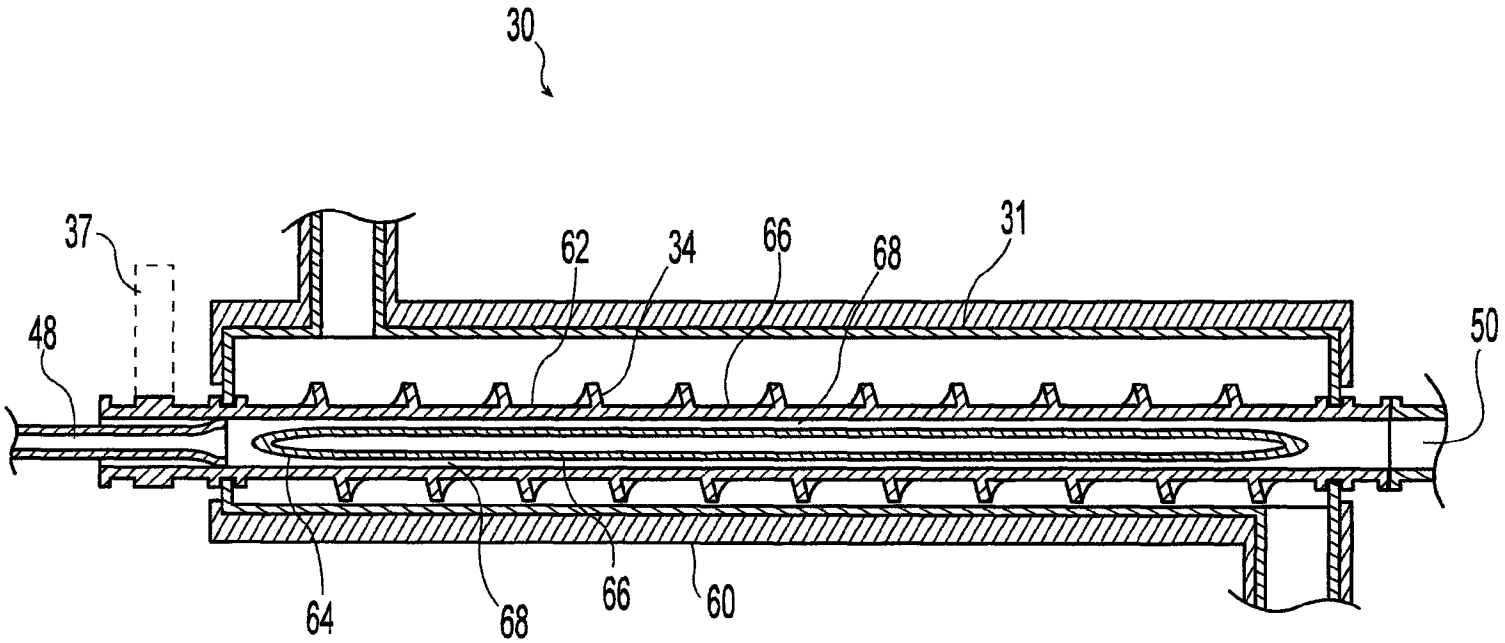
FIG. 4 is a cross sectional view through the pyrolyzer of FIG. 3 through the section marked 4-4 in FIG. 3.

A first embodiment of the pyrolyzer furnace 30 is shown in FIGS. 3 and 4. The pyrolyzer furnace of FIG. 3 comprises the longitudinal furnace housing 31 at least partially covered by an insulating layer 60. At least two drive screws 34, laterally positioned, adjacent and overlapping, capable of conveying carbon-bearing materials 14 containing volatile materials 28 through the pyrolyzer furnace 30, are rotatably mounted within the pyrolyzer furnace housing 31. The two drive screws are driven in a counter-rotated direction by a conventional drive not shown.

The pyrolyzer furnace housing 31 may be shaped to provide a volume above the drive screws 34, as illustrated in FIG. 3. The volume above the screws provides a space for coal particles 14 or other carbon-bearing materials to expand above the drive screws 34 as the material increases in temperature on moving through the pyrolyzer furnace 30. It is contemplated that some embodiments may provide more or less volume above the screws depending on the thermal expansion or swelling properties of the particular carbon-bearing materials that are processed through the pyrolyzer furnace 30.

As shown in FIG. 3, each drive screw 34 comprises a hollow drive shaft 62 in communication with the combustion chamber 42. The conduit 48 may connect the combustion chamber 42 with the drive shafts 62. The combustion chamber 42 is capable of burning fluidized volatile materials 28 and, if desired, other hydrocarbon fuels, and exhausting combustion fluids from the combustion chamber 42 through the conduit 48 into inner passageways 68 within the hollow drive shafts 62.

As shown in FIGS. 3 and 4, a diverter 64 is longitudinally positioned within the hollow drive shafts 62. Each diverter 64 comprises an outer surface 66 forming with an inner surface of the drive shaft 62 an inner passageway 68 capable of directing heated fluid adjacent the carbon-bearing materials moving through the pyrolyzer furnace 30, to fluidize the volatile material therein. In one embodiment, blower 44 moves the exhausted combustion fluids from the combustion chamber 42 through the conduit 48 and into the inner passageway 68 for heating the carbon-bearing material moving through the pyrolyzer furnace 30.

Figure 2:
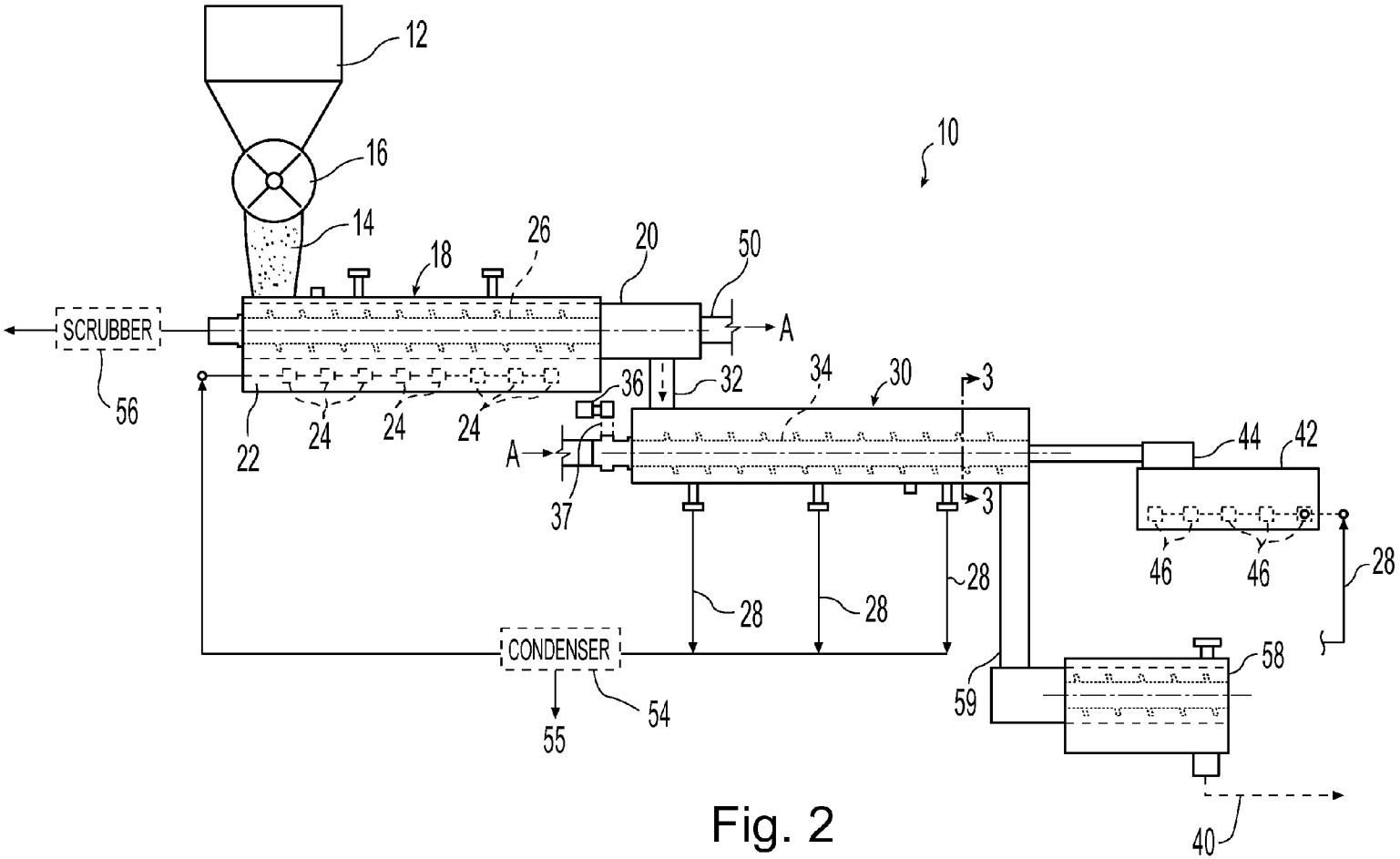
FIG. 2 is a second embodiment of a system for making char.

In the embodiment of FIG. 1, the exhausting combustion fluids flow through the inner passageways 68 of drive shafts 62 in the direction of the carbon-bearing materials moving through the pyrolyzer furnace housing 31. In the embodiment of FIG. 2, the exhausting combustion fluids flow through the inner passageways 68 of the drive shafts 62 opposite the direction of the carbon-bearing materials moving through the pyrolyzer furnace 30.

Figure 5:
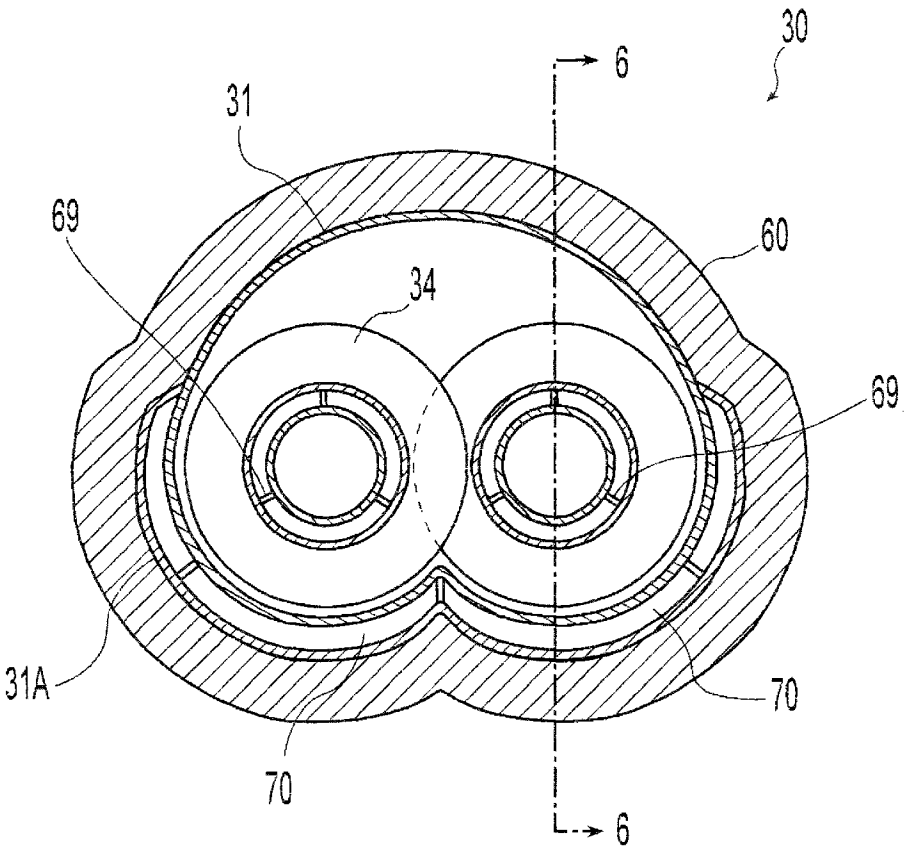
FIG. 5 is a cross sectional view through an alternate embodiment including a double wall pyrolyzer of the present disclosure through the section marked 3-3 in FIG. 1 or FIG. 2.

As illustrated in FIG. 5, diverter 64 may be centered within each hollow drive shaft 62 by a plurality of ribs 69 extending radially from the outer surface 66. The ribs 69 may extend along the lengths of the diverter 64. Alternately, a plurality of small ribs 69 may hold the diverter in place. In one embodiment, the ribs 69 have an airfoil shape. In another embodiment, the ribs 69 are shaped and positioned to disrupt the flow of fluid through the inner passageway 68 for creating turbulent flow. The ends of the diverter 64 may be tapered as illustrated in FIG. 4. Alternately, the ends of the diverter 64 may be flat, spherical, or any other shape suitable for directing flow into the inner passageways 68.

In one embodiment, the outer surface 66 of the diverter 64 comprises an approximately cylindrical shape. It is contemplated that the outer surface 66 may comprise a corrugated shape or other shape for forming inner passageways 68 having various shapes and desired fluid flow through inner passageways 68. In one embodiment, the outer surface 66 comprises a surface corrugated to direct flow in a spiral around the diverter 64. The outer surface 66 of the diverter 64 may comprise fluid agitators or other devices for causing a turbulent flow in the inner passageway 68. It is contemplated that the agitators or other devices may be protrusions, tabs, ribs, or other shapes suitable for causing turbulent flow in the inner passageway 68. It is contemplated that the location, size, and shape of the inner passageways 68 may be varied to generate a turbulent flow having a Reynolds Number greater than 4000.

In one embodiment, the pyrolyzer furnace 30 heats the carbon-bearing materials to a temperature within a range of approximately 650° F. to 1300° F. (approximately 340° C. to 700° C.) to fluidize volatile materials 28 within the carbon-bearing materials. In an alternate embodiment, the pyrolyzer furnace 30 heats the carbon-bearing materials containing volatile materials 28 to a temperature up to about 1700° F. (about 930° C.) or more. As different volatile materials fluidize at different temperatures, it is contemplated that the pyrolyzer furnace 30 may heat the carbon-bearing materials to a selected temperature for fluidizing the volatile materials within the carbon-bearing materials being processed.

The insulating layer 60 may be a ceramic or other high temperature insulative material. It is contemplated that the insulating layer 60 may be a fabricated structure, a wrapped insulation blanket, a sprayed-on insulative material, or any other insulative or composite material around the pyrolyzer furnace 30.

In the embodiment of FIGS. 1 and 2, the drive screw 26 of pre-dryer 18 comprises a hollow drive shaft 27 in communication with the dryer conduit 50. In one embodiment, the pre-dryer drive shaft 27 further comprises a diverter to form an inner passageway between the diverter and an inner surface of the drive shaft 27, capable of diverting heated fluid adjacent the carbon-bearing materials moving through the pre-dryer 18. Alternately, the drive shaft 27 may be capable of receiving oil, and the dryer conduit 50 is in communication with an oil heater for heating the oil flowing through the drive shaft 27. In one embodiment, the drive shaft 27 is a Holo-Flite® screw capable of receiving oil heated by the hot combustion fluids from the dryer conduit 50.

Figure 6:
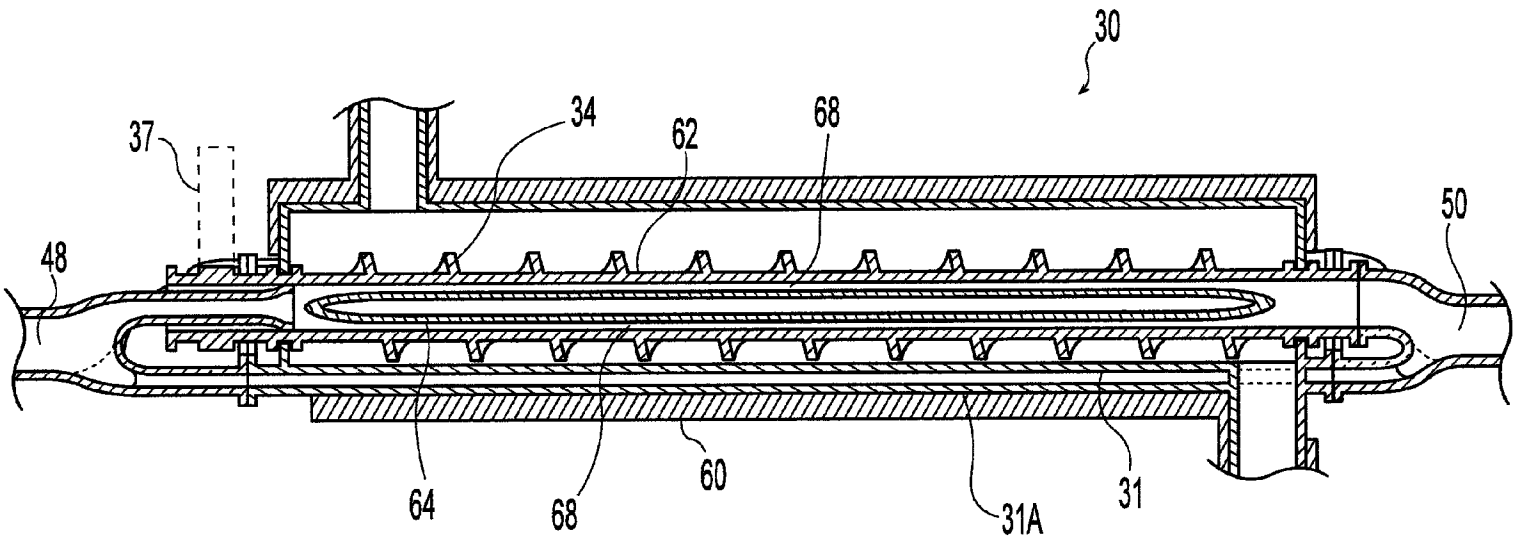
FIG. 6 is a cross sectional view through the pyrolyzer of FIG. 5 through the section marked 6-6 in FIG. 5.

In an alternate pyrolyzer embodiment shown in FIGS. 5 and 6, the pyrolyzer furnace 30 comprises double outer walls 31A within the pyrolyzer furnace housing 31 at least partially around the drive screws 34 and forming an outer passageway 70 between the outer walls capable of conveying a flow of heated fluid adjacent to the carbon-bearing material moving through the pyrolyzer furnace to fluidize the volatile material therein. The pyrolyzer furnace 30 of this embodiment is at least partially covered by the insulating layer 60. In the embodiment of FIGS. 5 and 6, the pyrolyzer furnace housing 31 comprises the partial double outer wall 31A, such that the outer passageway 70 surrounds a portion of the pyrolyzer furnace. Alternately, as in the embodiment of FIGS. 7 and 8, the double outer wall 31A may extend around the pyrolyzer furnace housing 31, such that the outer passageway 70 surrounds the pyrolyzer furnace 30.

In this embodiment, a conduit, such as the conduit 48, connects the outer passageway 70 to the combustion chamber 42 for conveying exhausted combustion fluids into the outer passageway 70. The combustion chamber 42 is capable of combusting fluidized volatile materials 28 and/or other hydrocarbon fuels, and exhausting combustion fluids through the outer passageway 70 for heating the carbon-bearing materials within the pyrolyzer furnace.

In the embodiments of FIGS. 5 to 8, the blower 44 may move the exhausted combustion fluids from the combustion chamber 42 through the conduit 48, and into the inner passageways 68 of the drive shafts 62 and the outer passageway 70, thereby heating the carbon-bearing material moving through the pyrolyzer furnace 30. It is contemplated that the location, size, and shape of the inner passageways 68 and the outer passageway 70, and the ribs within, may be varied to cause the flow of heated fluid through said passageways to have a turbulent flow having a Reynolds Number greater than 4000.

The outer passageway 70 may have fluid agitators or other devices positioned between the double walls for causing a turbulent flow of heated fluid therein. It is contemplated that the agitators or other devices may be protrusions, tabs, ribs, or other shapes suitable for causing turbulent flow in the outer passageway 70. It is further contemplated that the location, size, and shape of the outer passageway 70 may be varied to cause the flow of heated fluid through said passageway to have a turbulent flow having a Reynolds Number greater than 4000.

Figure 7:
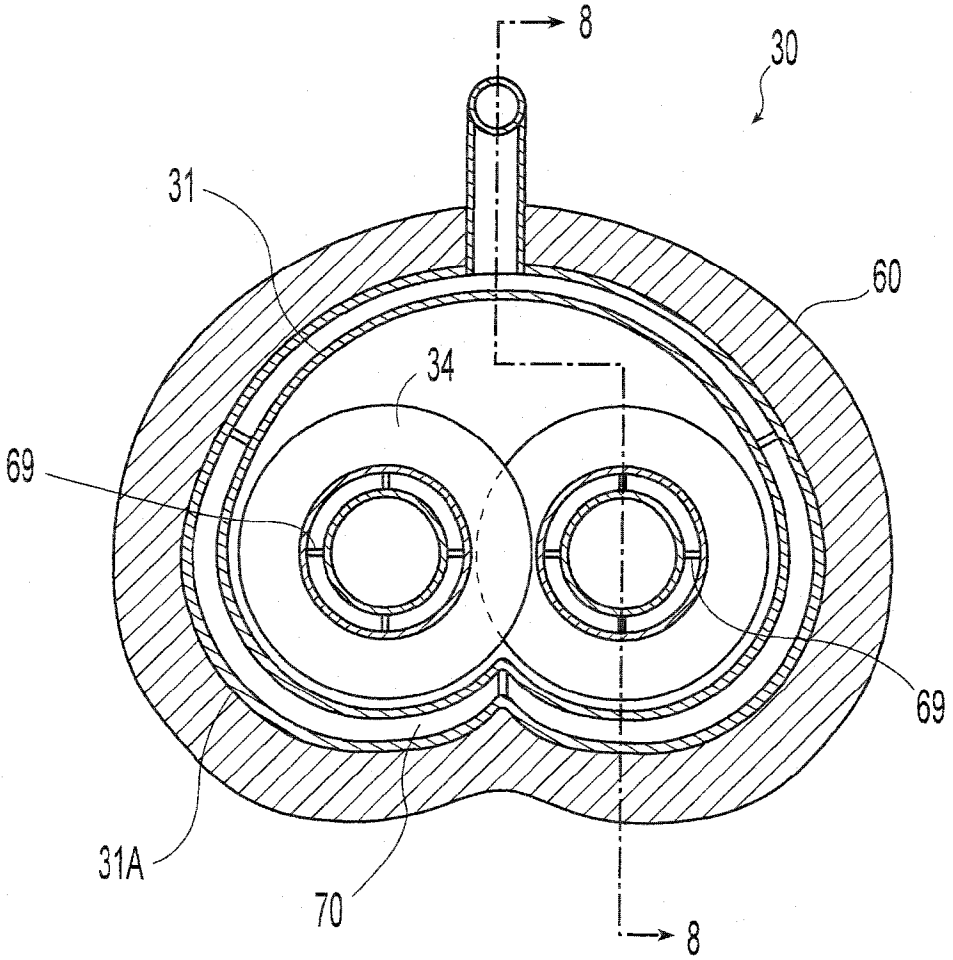
FIG. 7 is a cross sectional view through a third embodiment of a double wall pyrolyzer of the present disclosure through the section marked 3-3 in FIG. 1 or FIG. 2.
Figure 8:
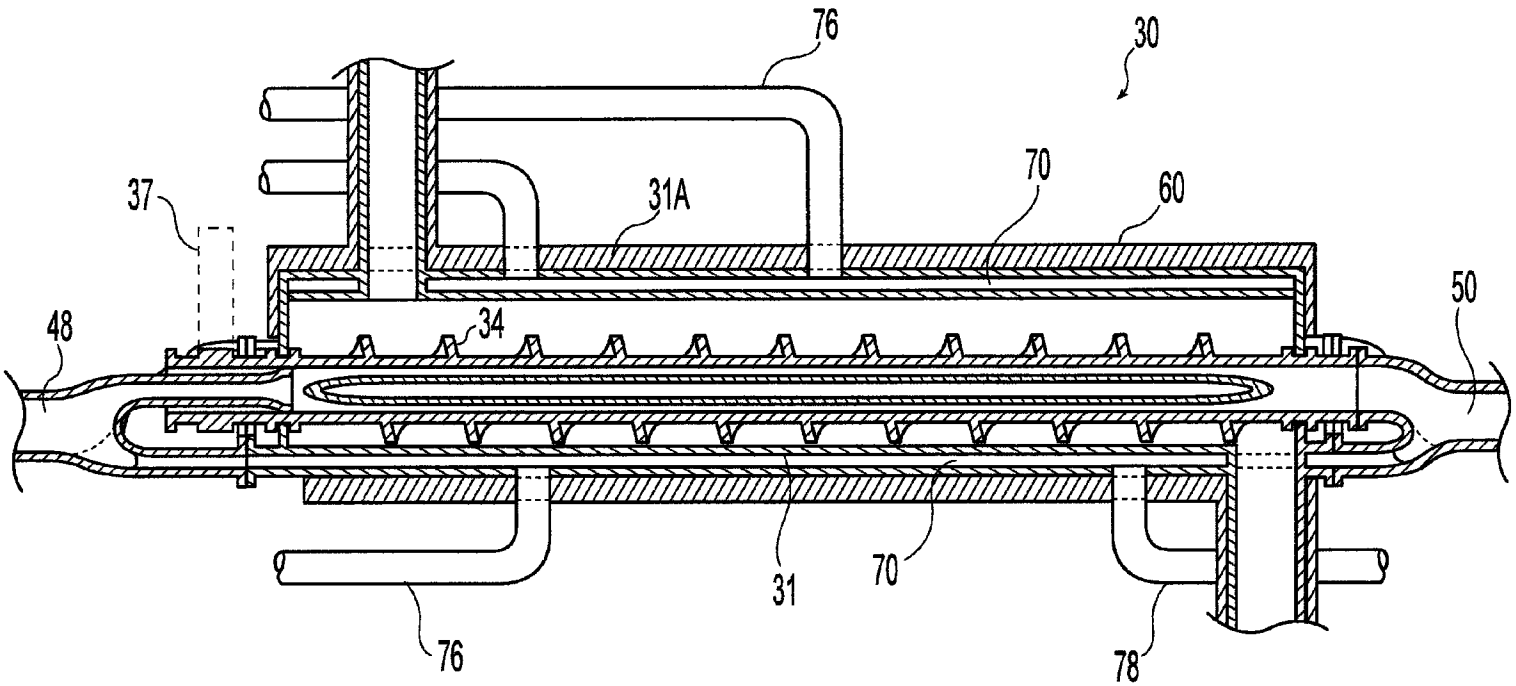
FIG. 8 is a cross sectional view through the pyrolyzer of FIG. 7 through the section marked 8-8 in FIG. 7.

As shown in FIGS. 7 and 8, optionally, one or more manifold conduits 76 may be provided for conveying heated fluid to a selected portion of the outer passageway 70 along the pyrolyzer furnace housing 31. The manifold conduits 76 may be in communication with the combustion chamber 42, and capable of transferring heated fluid to a selected portion of the outer passageway 70 longitudinally along the pyrolyzer furnace housing 31. The manifold conduits 76 may be provided to maintain a selected temperature distribution along the pyrolyzer furnace 30. In this embodiment, the combustion chamber 42 may transfer through conduit 48 exhausting combustion fluids to the inner passageways 68, the outer passageway 70, and the manifold conduits 76. At least one exit conduit 78 may be provided for transferring fluid out of the outer passageway 70. The heated fluids may enter the outer passageway 70 through an entry end of the pyrolyzing furnace housing 31, one or more manifold conduits 76, or any suitable location.

Figure 9:
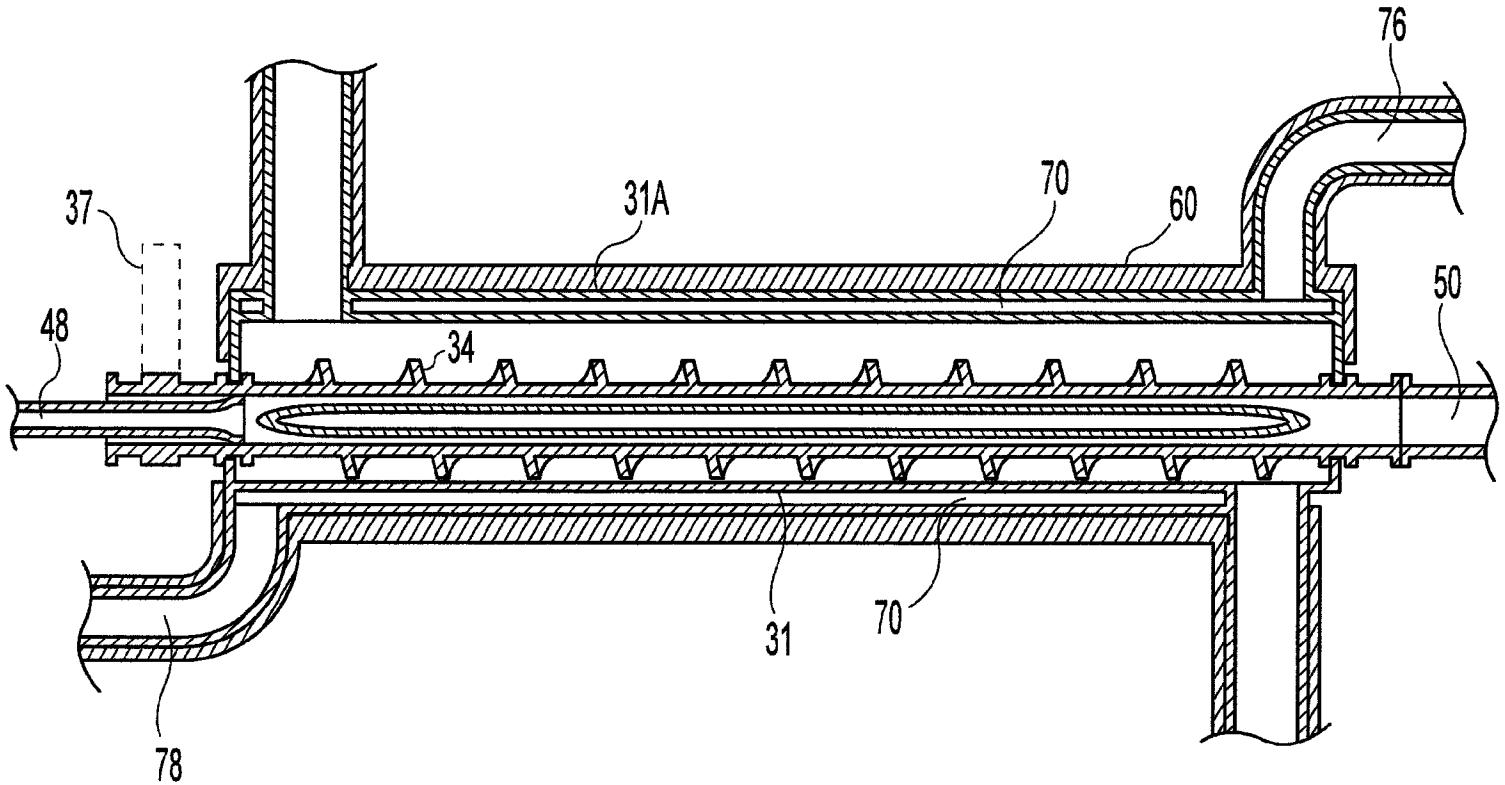
FIG. 9 is a cross sectional view through a fourth embodiment of a pyrolyzer furnace of the present disclosure.

As shown in FIG. 9, the flow of heated fluid in the inner passageways 68 and outer passageway 70 may be opposite the direction of movement of carbon-bearing material through the pyrolyzer furnace 30. In this embodiment, heated fluid enters the outer passageway 70 by way of one or more manifold conduits 76, and transfers out of the outer passageway 70 by way of one or more exit conduits 78.

Figure 10:
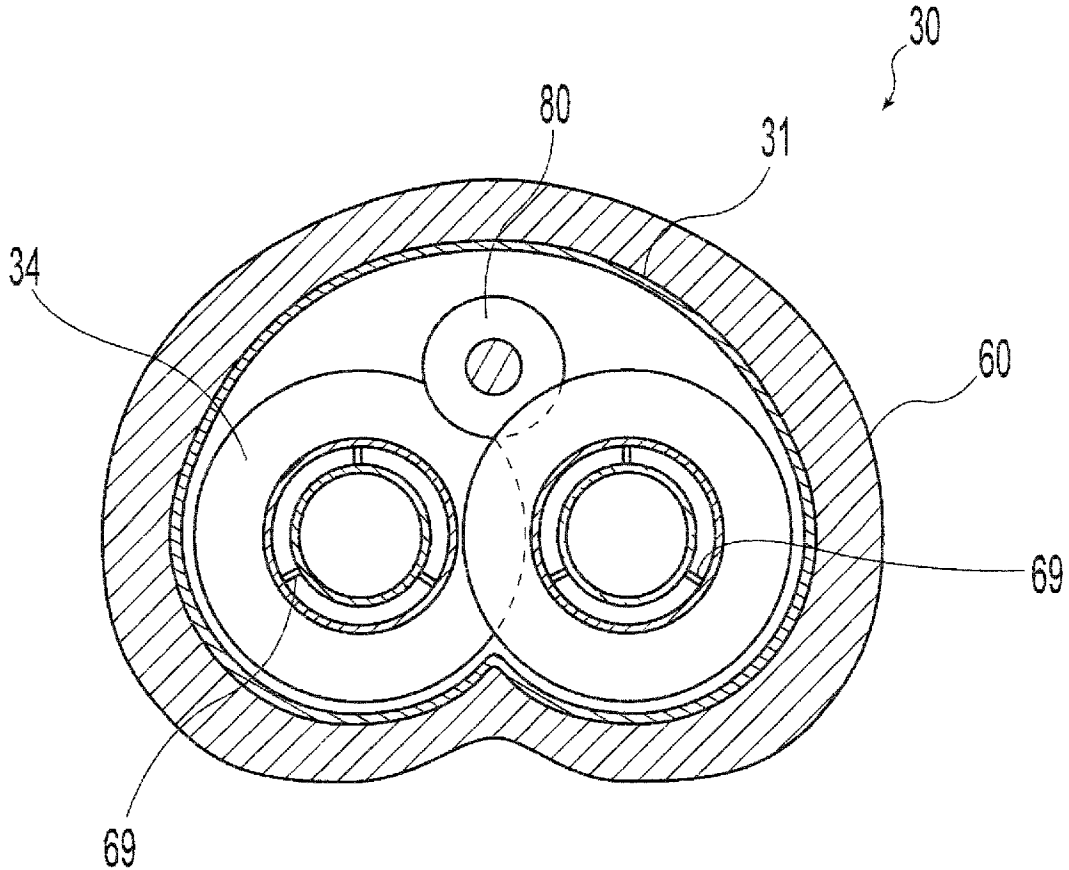
FIG. 10 is a cross sectional view through a fifth embodiment of a pyrolyzing furnace with three screws through the section marked 3-3 in FIG. 1 or FIG. 2.

In one embodiment shown in FIG. 10, the pyrolyzer furnace 30 comprises at least three screws laterally positioned adjacent and overlapping, the screws being positioned such that each screw overlaps at least one other screw. In the embodiment of FIG. 10, two larger drive screws 34 are provided, and one clearing screw 80 is provided having a smaller diameter than adjacent drive screws 34 and positioned longitudinally through the furnace housing adjacent the drive screws. The clearing screw 80 may be capable of conveying carbon-bearing materials from the drive screws 34 through the pyrolyzer furnace housing. It is contemplated that alternate embodiments may comprise at least three drive screws 34 and two clearing screws 80. Alternately, four larger drive screws 34 and three smaller clearing screws 80 may be provided. It is contemplated that any number of screws may be provided to accommodate a desired capacity of carbon-bearing material to be processed. In one embodiment, at least two drive screws are driven in a counter-rotated direction.

In one embodiment, clearing screw 80 may comprise a hollow drive shaft and a diverter, forming an inner passageway being in communication with heated fluids from the combustion chamber 42, as disclosed above with reference to the larger drive screws 34.

Figure 11:
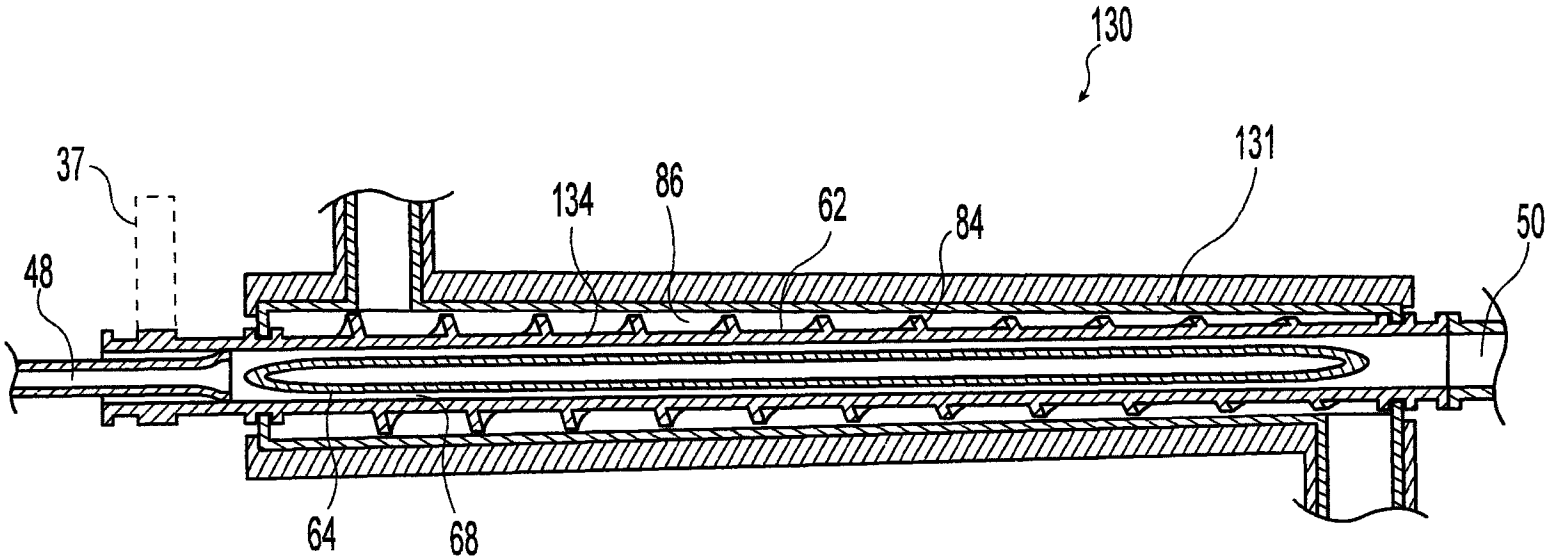
FIG. 11 is a longitudinal cross sectional view through a sixth embodiment of a compacting pyrolyzer of the present disclosure.

As shown in FIG. 11, the portion of the pyrolyzer furnace housing through which the carbon-bearing material moves may have a decreasing cross sectional area in the direction of travel of the carbon-bearing material through the pyrolyzer furnace housing. FIG. 11 illustrates pyrolyzer furnace 130 having a tapered pyrolyzer furnace housing 131 with a tapered outer wall forming a decreasing cross-sectional area of the portion of the pyrolyzer furnace housing through which the carbon-bearing material moves in the direction of travel of the carbon-bearing material. In this embodiment, the tapered pyrolyzer furnace housing 131 comprises at least two rotatably mounted tapered drive screws 134, laterally positioned adjacent and overlapping, and being capable of conveying carbon-bearing materials containing volatile materials 28 through the pyrolyzer furnace 130. Two drive screws are driven in a counter-rotated direction.

As shown in FIG. 11, the tapered drive screws 134 comprise a screw flight 84 having a decreasing diameter corresponding to the reducing cross section of the pyrolyzer furnace 130, and hollow drive shafts 62 in communication with the combustion chamber 42. Thus, in this embodiment, the portion 86 located between the drive shaft 62 and the pyrolyzer furnace housing 131, through which the carbon-bearing materials move, decreases in cross sectional area along the length of the pyrolyzer furnace.

As carbon-bearing materials containing volatile materials convey through the pyrolyzer of the embodiment of FIG. 11, the carbon-bearing materials are forced into the reducing area 86 by the screw flight 84, thereby compacting the carbon-bearing materials as they are conveyed through the pyrolyzer furnace and become char.

In this embodiment, the diverter 64 is positioned within the hollow drive shafts 62. The diverter 64 comprises the outer surface 66 forming with the inner surface of the drive shaft 62 an inner passageway 68 capable of diverting heated fluid adjacent the carbon-bearing materials moving through the pyrolyzer furnace 130 to fluidize the volatile material therein. In one embodiment, the blower 44 moves the exhausted combustion fluids from the combustion chamber 42 through the conduit 48 and into the inner passageway 68 for heating the carbon-bearing materials moving through the pyrolyzer furnace 130.

Figure 12:
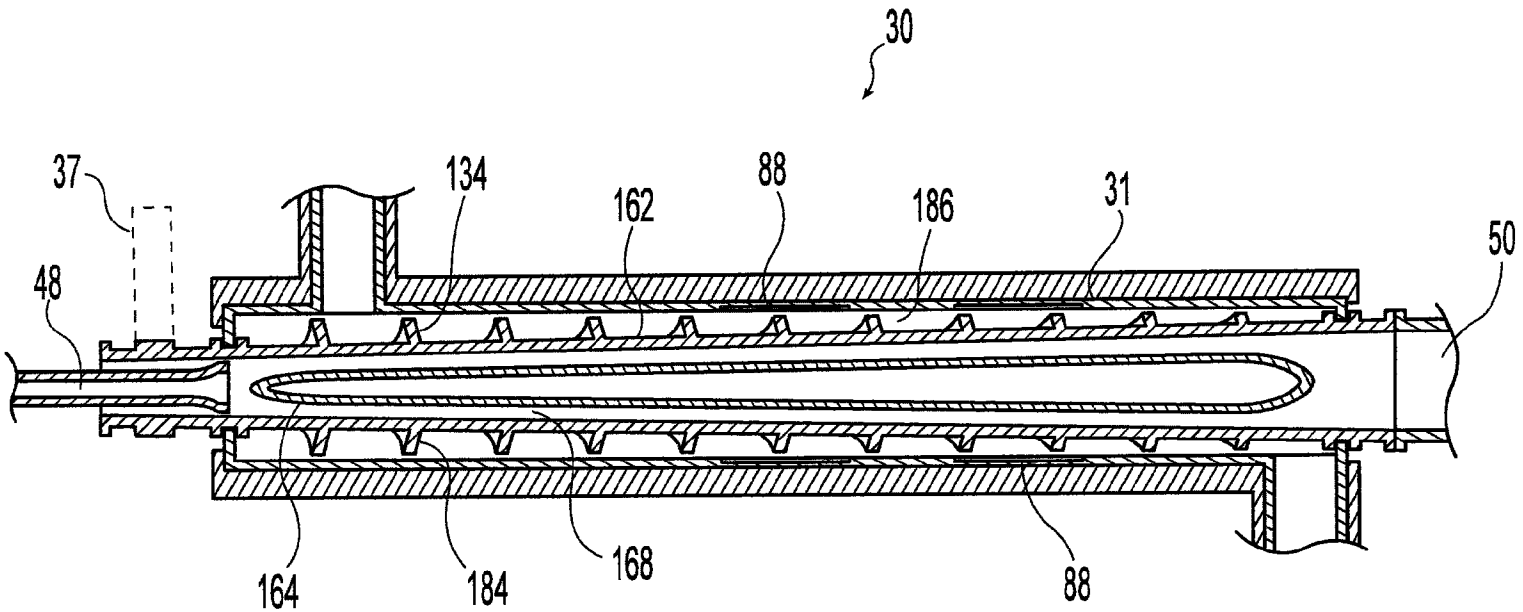
FIG. 12 is a longitudinal cross sectional view through a seventh embodiment of a compacting pyrolyzer of the present disclosure.

In an alternate compacting embodiment shown in FIG. 12, the pyrolyzer furnace 30 comprises at least two rotatable tapered drive screws 134, laterally positioned adjacent and overlapping, and capable of conveying carbon-bearing materials containing volatile materials through the pyrolyzer furnace 30.

In this embodiment, each tapered drive screw 134 comprises a hollow tapered drive shaft 162 in communication with and heated by the combustion chamber 42, and a screw flight 184 having a given outside diameter adjacent to an inner wall of the pyrolyzer furnace housing 31. In this embodiment, the hollow drive shafts 162 through each screw has a tapered outer wall with an increasing diameter along the length of the screw in the direction of travel of the carbon-bearing materials. The tapered outer wall of the drive shaft 162 is capable of reducing the cross-sectional area of the portion 186 of the pyrolyzer furnace housing 31 through which the carbon bearing material moves, located between the hollow drive shaft 162 and the pyrolyzer furnace housing 31, in the direction of travel of the carbon-bearing materials through the pyrolyzer furnace housing. Optionally, the pyrolyzer furnace 30 may comprise one or more slots 88 to provide an area for the carbon-bearing materials to expand.

As the carbon-bearing materials containing volatile materials convey through the pyrolyzer of the embodiment of FIG. 12, the carbon-bearing materials are forced in portion 186 through a reduced cross-section by the screw flight 184, thereby compacting the carbon-bearing materials as they convey through the pyrolyzer furnace 30.

In this embodiment, a tapered diverter 164 is positioned within the hollow drive shafts 162. The tapered diverter 164 comprises a reverse taper cooperating with the taper of the drive shaft 162 to form one or more inner passageways 168 through the drive shaft 162, capable of diverting heated fluid adjacent the carbon-bearing materials moving through the pyrolyzer furnace 30 to fluidize the volatile material therein. The blower 44 moves the exhausted combustion fluids from the combustion chamber 42 through the conduit 48 and into the inner passageway 168 for heating the carbon-bearing material moving through the pyrolyzer furnace 30.

In the embodiment of FIG. 12, optionally, the pyrolyzer furnace housing 131 may have tapered inner walls (not shown). The tapered inner walls may be coordinated with the tapered outer walls of the hollow drive shafts 162 to decrease the cross sectional area of the portion of the pyrolyzer furnace housing through which the carbon-bearing material moves in the direction of travel of the carbon-bearing material through the pyrolyzer furnace.

Figure 13:
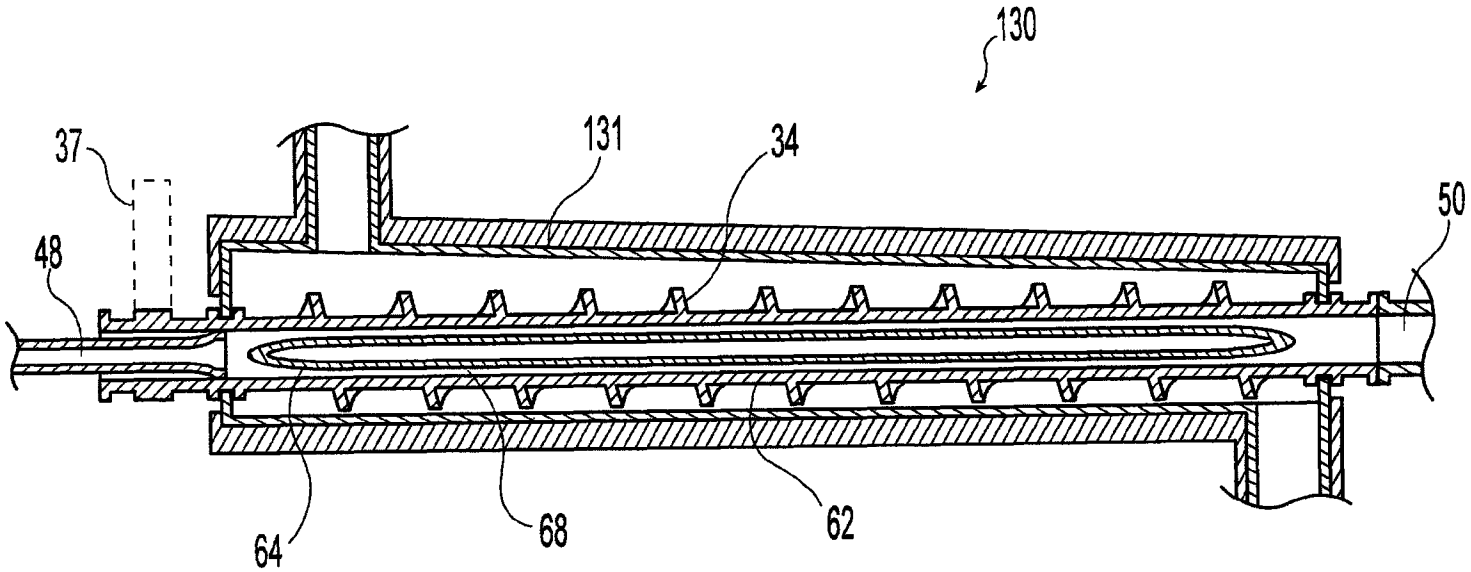
FIG. 13 is a longitudinal cross sectional view through an eighth embodiment of a compacting pyrolyzer of the present disclosure.

In another alternate compacting embodiment shown in FIG. 13, the tapered pyrolyzer furnace 130 comprises at least two of the drive screws 34, laterally positioned adjacent and overlapping, and being capable of conveying carbon-bearing materials containing volatile materials through the pyrolyzer furnace 130. In the embodiment of FIG. 13, the drive screws 34 comprise hollow drive shafts 62 in communication with and heated by fluid exhausted from the combustion chamber 42. Two drive screws 34 are driven in a counter-rotating direction to move the carbon-bearing materials through the pyrolyzer furnace 130.

In this embodiment, the pyrolyzer furnace 130 comprises a tapering volume above the drive screws 34. The volume above the drive screws 34 provides a space for carbon-bearing materials such as coal particles 14 to expand above the drive screws 34 as the temperature of the carbon-bearing materials increases and the volatile materials are fluidized. In the embodiment of FIG. 13, the volume above the drive screws has a longitudinal taper with a reducing cross sectional area along the length of the pyrolyzer furnace housing 131 in the direction of travel of the carbon-bearing materials.

Thus, in this embodiment, the portion of the pyrolyzer furnace 130 through which the carbon-bearing materials move has a decreasing volume along the length of the pyrolyzer. As carbon-bearing materials containing volatile materials convey through the pyrolyzer of this embodiment, the carbon-bearing materials are forced into the reducing volume of the pyrolyzer furnace 130 by the drive screws 34, thereby compacting the carbon-bearing materials as they convey through the pyrolyzer.

In this embodiment, the diverter 64 is positioned within the hollow drive shafts 62. The diverter 64 comprises the outer surface 66 forming with the inner surface of the drive shaft 62 an inner passageway 68 through the drive shaft 62, capable of diverting heated fluid adjacent the carbon-bearing materials moving through the pyrolyzer furnace 230 to fluidize the volatile material therein. In one embodiment, the blower 44 moves the exhausted combustion fluids from the combustion chamber 42 through the conduit 48 and into the inner passageway 68 for heating the carbon-bearing materials moving through the pyrolyzer furnace 130.

Figure 14:
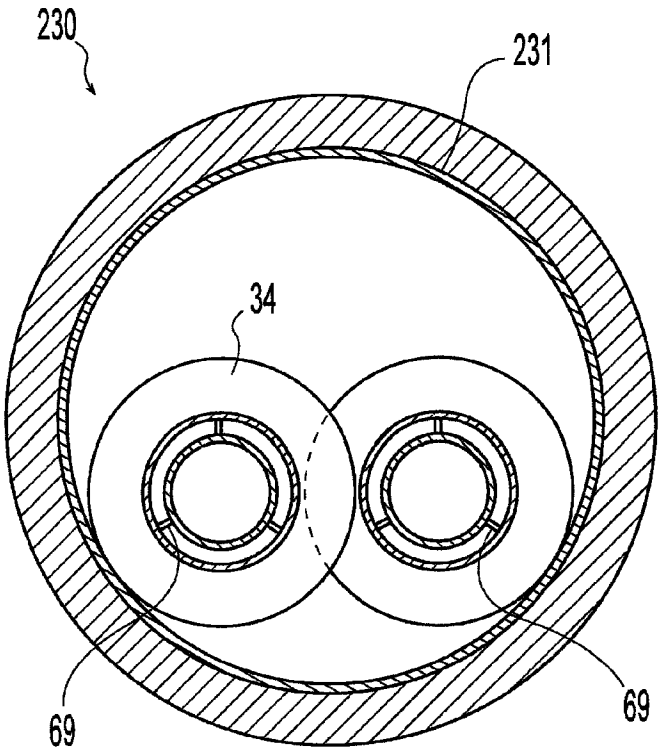
FIG. 14 is a longitudinal cross sectional view through a ninth embodiment of a rotatable pyrolyzer of the present disclosure.

In the embodiment of FIG. 14, a pyrolyzer furnace 230 comprises a rotatable outer wall at least partially covered by an insulating layer 60. At least two drive screws 34, laterally positioned adjacent and overlapping, and being capable of conveying carbon-bearing materials containing volatile materials 28 through the pyrolyzer furnace 230, are rotatably mounted within the pyrolyzer furnace for conveying the carbon-bearing material, such as coal particles 14, through the pyrolyzer. Two drive screws 34 are driven in a counter-rotating direction.

In the embodiment of FIG. 14, the pyrolyzer furnace 230 comprises a generally cylindrical pyrolyzer furnace housing 231, where at least a portion of the pyrolyzer furnace housing 231 is rotatably driven about its longitudinal axis. The end walls of the cylindrical furnace may be fixed relative to the rotating cylindrical portion. In this embodiment, the screws may be supported by non-rotating end walls or other non-rotating portion of the pyrolyzer furnace 230.

In this embodiment, each drive screw 34 may rotate about its longitudinal axis, and the pyrolyzer furnace outer wall may rotate about its longitudinal axis. The longitudinal axes of the screws and the pyrolyzer furnace may be oriented in a fixed relationship. At least a portion of the pyrolyzer furnace housing 231 may be rotatable around the drive screws 34.

In the embodiment of FIG. 14, it is contemplated that the pyrolyzer furnace 230 may comprise a double outer wall (not shown) within the pyrolyzer furnace housing 231 at least partially around the drive screws 34. Such a double outer wall forms an outer passageway between the outer walls capable of conveying a flow of heated fluid adjacent to the carbon-bearing material moving through the pyrolyzer furnace to fluidize the volatile materials therein. In one embodiment, heated fluid may be directed into the double wall cavity through a conduit, plenum or other channel through the non-rotating portion of the pyrolyzer furnace 230.

As shown in FIG. 14, each drive screw 34 may comprise a hollow drive shaft 62 in communication with the combustion chamber 42. The diverter 64 is positioned within the hollow drive shafts 62. The diverter 64 comprises the outer surface 66 forming with an inner surface of the drive shaft 62 an inner passageway 68 capable of diverting heated fluid adjacent the carbon-bearing materials moving through the pyrolyzer furnace 230, to fluidize the volatile material 28 therein. The blower 44 may move the exhausted combustion fluids from the combustion chamber 42 through the conduit 48 and into the inner passageways 68 for heating the carbon-bearing material moving through the pyrolyzer furnace 230. The location, size, and shape of the inner passageways 68 may be varied to cause the flow of heated fluid through said passageways to have a turbulent flow having a Reynolds Number greater than 4000.

The conduit 48 may connect the combustion chamber 42 with the drive shafts 62. The combustion chamber 42 is capable of combusting fluidized volatile materials 28 and/or other hydrocarbon fuels, and exhausting combustion fluids through the inner passageways 68. In one embodiment, the blower 44 moves exhausted combustion fluids through the conduit 48 and through the inner passageways 68.

The diverter 64 may be centered within the hollow drive shaft 62 by a plurality of ribs 69 extending along the outer surface 66. The ribs may extend continuously the length of the diverter. Alternately, a plurality of small ribs holds the diverter in place. In one embodiment, the ribs 69 have an airfoil shape. If desired, the ribs 69 may be shaped and positioned to disrupt flow of gas through the inner passageway 68 for creating turbulent flow. The ends of the diverter 64 may be tapered. Alternately, the ends of the diverter may be flat, spherical, or any other shape suitable for directing flow into the inner passageways 68.

Figure 15:
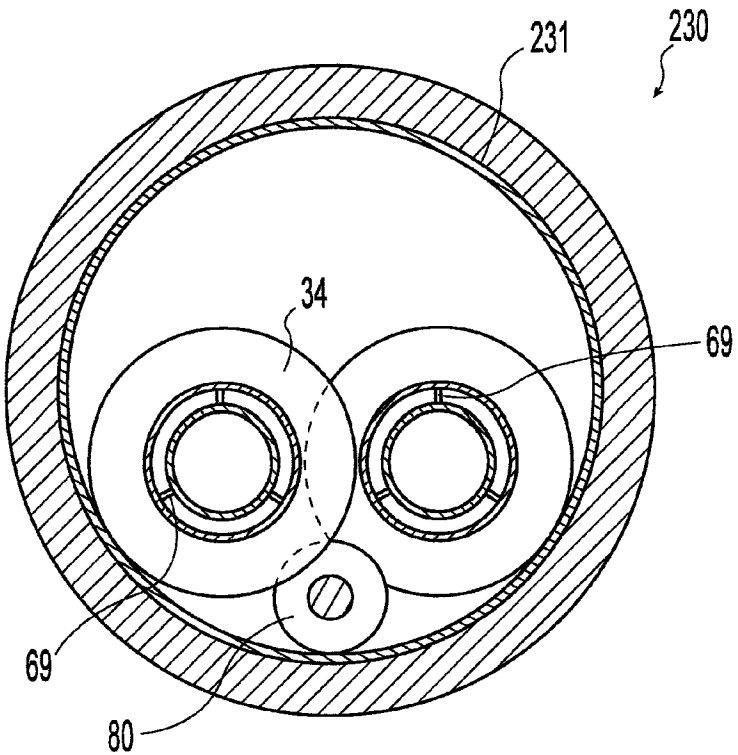
FIG. 15 is a longitudinal cross sectional view through a tenth embodiment of a rotatable pyrolyzer of the present disclosure.

As shown in FIGS. 14 and 15, the insulating layer 60 may be a ceramic or other high temperature insulative material. The insulating layer 60 may be a fabricated structure, a wrapped insulation blanket, a sprayed-on insulative material, or any other insulative or composite material around the pyrolyzer furnace 230.

In one rotatable furnace embodiment shown in FIG. 15, the pyrolyzer furnace 230 may comprise at least three screws laterally positioned adjacent and overlapping, the screws being positioned such that each screw overlaps at least two other screws. Two larger drive screws 34 are provided, and one clearing screw 80 is provided having a smaller diameter than an adjacent drive screw 34. It is contemplated that alternate embodiments (not shown) may comprise more than two larger drive screws 34 and at least two smaller clearing screws 80 arranged to convey carbon-bearing materials within the rotatable pyrolyzer furnace 230. In one embodiment, at least two screws turn in opposite directions as counter rotating screws.

In one embodiment, clearing screw 80 comprises a hollow drive shaft and a diverter, the hollow drive shaft being in communication with and heated by the fluids from combustion chamber 42, as disclosed above with reference to the larger drive screws 34.

The char produced in the pyrolyzer furnace 30 may be used in various commercial applications. In some commercial processes, the char may be mixed with supplemental materials, such as silicon or iron ore for use in other processes. We have found that when the char is in a heated, plastic state within the pyrolyzer, other materials can be added and mixed with the plasticized char. The supplemental materials added to the plasticized char become well-mixed in the char when the char solidifies and cools.

Figure 16:
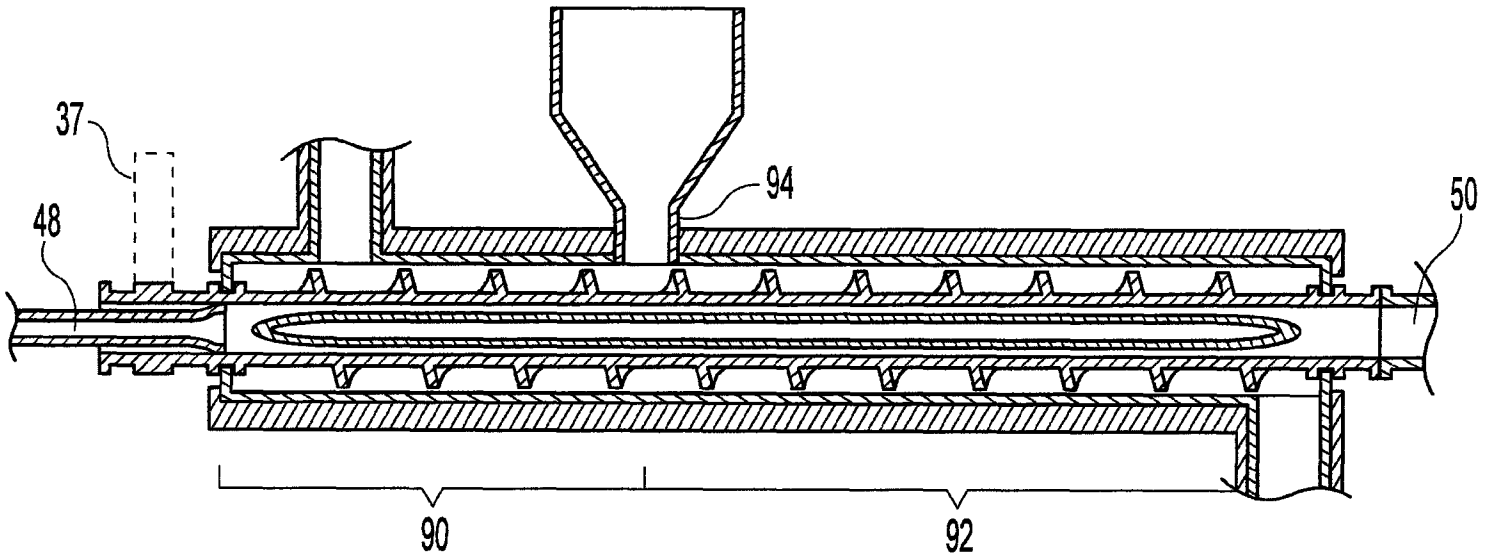
FIG. 16 is a longitudinal cross sectional view through an eleventh embodiment of a pyrolyzer of the present disclosure with mixing capability.

In the embodiment of FIG. 16, the pyrolyzer furnace 30 comprises a first zone 90 capable of fluidizing volatile materials and a second zone 92 capable of mixing supplemental materials into the char. In the embodiment of FIG. 16, a second zone inlet 94 may be provided for introducing supplemental materials into the furnace housing 31. The second zone inlet 94 may be positioned adjacent the beginning of the second zone 92. In this embodiment, the second zone 92 begins at a location where the carbon-bearing materials in the pyrolyzer furnace become molten, or at about ⅓ of the length of the pyrolyzer furnace, and the supplemental material may be introduced into the second zone and mixed into the char.

The pyrolyzer furnace of any of the foregoing embodiments may heat the carbon-bearing materials to a temperature within a range of approximately 650° F. to 1300° F. (approximately 340° C. to 700° C.) to fluidize the volatile materials 28 contained in the carbon-bearing materials. In an alternate embodiment, the pyrolyzer furnace 30 heats the carbon-bearing materials containing volatile materials 28 to a temperature of approximately 1700° F. (approximately 930° C.) or more. As different volatile materials fluidize at different temperatures, it is contemplated that the pyrolyzer furnace 30 may heat the carbon-bearing materials to a selected temperature for fluidizing the volatile materials within the carbon-bearing materials being processed.

Figure 17A:
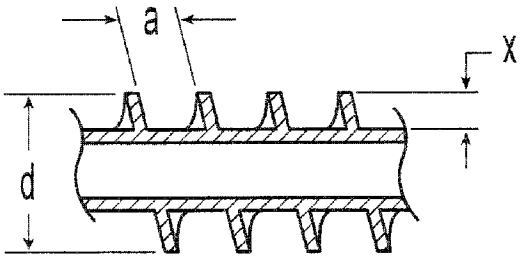
FIGS. 17A and 17B are partial cross sections illustrating two alternate screw flight designs for the pyrolyzer of the present disclosure.
Figure 17B:
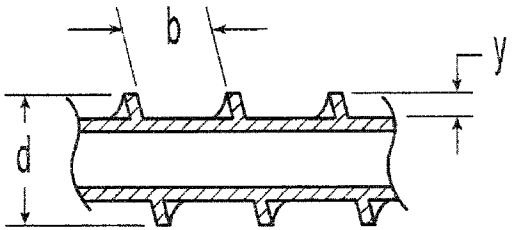

It is contemplated that the screw flights of the screws in any of the foregoing embodiments may be varied to process different carbon-bearing materials and at different rates. For example, for a given screw diameter, a screw flight may have tall, closely spaced flights as illustrated by FIG. 17A, or short, spaced apart flights as illustrated by FIG. 17B. It is contemplated that the screw design may be varied depending on the heat transfer properties of different carbon-bearing materials being processed and desired production capacity.

In any of the foregoing embodiments, it is contemplated that the pyrolyzer may be inclined upwardly in the direction of movement of the carbon-bearing material through the pyrolyzer furnace housing. An inclined pyrolyzer furnace may increase heat transfer by providing more surface contact between the carbon-bearing materials and the pyrolyzer. It is further contemplated that the incline angle may be variable to accommodate processing of different coals and other carbon-bearing materials. An inclined pyrolyzer may also reduce the amount of floor space used by the pyrolyzer.

The flow of exhausted combustion fluids through the inner passageways 68, formed between the diverter and the inner surface of the hollow drive shaft, may be in the same direction as the drive screws move the carbon-bearing materials through the pyrolyzer furnace housing. Alternately, the exhausting combustion fluids flow through the inner passageways opposite the direction of the carbon-bearing materials moving through the pyrolyzer furnace.

When some carbon-bearing materials are heated in a pyrolyzer to a temperature sufficient to fluidize volatile materials, the carbon-bearing material may transition to a plastic stage. Some carbon-bearing materials in a plastic stage have tar-like adhesive properties that cause the material to drag or stick to the screw flights. In one char making apparatus, one drive screw has a different screw pitch than an adjacent screw, and positioned such that one screw wipes material from other screw. Also, the drive screws 34 may be able to be reversed in rotation, or driven at different rotational speeds, to assist in keeping the drive screws 34 free of processed carbon-bearing material.

It is contemplated that the pitch of a screw may change along the length of the screw to accommodate the carbon-bearing material in a solid state at the entry end of the furnace to a plastic state within the furnace.

Water may be introduced into any of the foregoing pyrolyzer furnace embodiments for partial gasification of the carbon-bearing materials in the furnace. In one embodiment, water is introduced into the pyrolyzer furnace where the carbon-bearing material containing volatile materials reaches a temperature to fluidize the volatile materials. The water may react with the fluidized volatile materials for producing carbon monoxide and hydrogen compounds such as hydrogen gas and methane in addition to char.

It is contemplated that the fluidized volatile materials 28 removed from the carbon-bearing materials may be sufficient to fuel the burners 46 in the combustion chamber 42 without supplemental fuel. However, it is further contemplated that some carbon-bearing materials may not devolatilize a sufficient amount of volatile material to fuel the combustion chamber 42, at least during the start of the pyrolyzer furnace. The hydrogen produced from the introduction of water may be used to additionally fuel the combustion chamber 42.

By the pyrolyzer furnace, various carbon and hydrocarbon-bearing products, such as municipal waste, organic material, tires, hydrocarbon sludge, tar sand, oil shale, coal fines and other carbon-bearing materials may be effectively processed into char.

While the invention has been described with detailed reference to one or more embodiments, the disclosure is to be considered as illustrative and not restrictive. Modifications and alterations will occur to those skilled in the art upon a reading and understanding of this specification. It is intended to include all such modifications and alterations in so far as they come within the scope of the claims, or the equivalence thereof.

What is claimed is:

1. A method for making char comprising the steps of:

a. conveying carbon-bearing materials containing volatile material through a longitudinal pyrolyzer furnace housing, the longitudinal pyrolyzer furnace housing having at least two counter rotatable drive screws laterally positioned and overlapping within the longitudinal furnace housing, and each drive screw having a hollow drive shaft and a diverter longitudinally positioned within the drive shaft, the diverter forming with an inner surface of each drive shaft an inner passageway capable of directing heated fluid adjacent the carbon-bearing materials moving through the pyrolyzer furnace to fluidize the volatile material therein;

b. burning fluidized volatile material and, if desired, other hydrocarbon fuels, in a combustion chamber adjacent the longitudinal pyrolyzer furnace housing, and exhausting combustion fluids through the inner passageway within the hollow drive shaft of the drive screws within the pyrolyzer furnace housing; and c. counter rotating the drive screws to cause carbon-bearing material containing volatile materials to move through the longitudinal pyrolyzer furnace housing and be heated to a temperature to fluidize volatile materials therein.

2. The method of making char as claimed in claim 1, further comprising the step of:

transferring fluidized volatile material from the pyrolyzer furnace to the combustion chamber.

3. The method of making char as claimed in claim 1, where the flow of combustion fluids through the inner passageways within the hollow drive shafts of the drive screws is in the same direction as the movement of the carbon-bearing materials through the pyrolyzer furnace housing.

4. The method of making char as claimed in claim 1, further comprising the step of:

providing a turbulent flow of combustion fluids through the inner passageways having a Reynolds Number greater than 4000.

5. The method of making char as claimed in claim 1, further comprising the step of:

tapering outer walls of the hollow shafts of the drive screws to cause the carbon-bearing material to be compressed as it moves through the pyrolyzer furnace housing.

6. The method of making char as claimed in claim 1, further comprising the step of:

reducing the cross sectional area of the portion of the pyrolyzer furnace housing through which the carbon-bearing material moves in the direction of movement of the carbon-bearing material through the housing to compress the carbon-bearing materials as it moves through the pyrolyzer furnace housing.

7. The method of making char as claimed in claim 1, further comprising the step of:

rotating at least a portion of the pyrolyzer furnace housing around the drive screws while rotating the drive screws to convey carbon-bearing materials through the pyrolyzer furnace housing.

8. The method of making char as claimed in claim 1, further comprising the step of:

heating the volatile materials in the carbon-bearing material to a temperature within a range of approximately 650° F. to 1300° F.

9. The method of making char as claimed in claim 1, further comprising the step of:

raising an end of the pyrolyzer furnace housing to provide a variable elevation in the direction of travel of the carbon-bearing material through the pyrolyzer furnace housing.

10. The method of making char as claimed in claim 1, further comprising the step of:

providing at least three drive screws laterally positioned within the pyrolyzer furnace housing, with each screw being positioned such that the drive screws overlaps at least one other screw.

11. The method of making char as claimed in claim 1, comprising the additional steps of:

providing a first zone and a second zone in the pyrolyzer furnace housing, where the first zone is capable of fluidizing volatile materials, and the second zone is capable of mixing supplemental materials into the carbon-bearing materials, and introducing the supplemental materials into the furnace housing in the second zone.

12. The method of making char as claimed in claim 1, further comprising the step of:

conveying heated fluid through at least one manifold conduit to a selected portion of the outer passageway along the pyrolyzer furnace housing.

13. A method of making char comprising the steps of:

a. conveying carbon-bearing materials containing volatile material through a longitudinal pyrolyzer furnace housing, the longitudinal pyrolyzer furnace housing having at least two counter rotatable drive screws laterally positioned and overlapping within the longitudinal furnace housing, and each drive screw having a hollow drive shaft and a diverter longitudinally positioned within the drive shaft, the diverter forming with an inner surface of each drive shaft an inner passageway capable of directing heated fluid adjacent the carbon-bearing materials moving through the pyrolyzer furnace to fluidize the volatile material therein, and having double outer walls within the furnace housing at least partially around the rotatable drive screws and forming an outer passageway between the outer walls, the outer passageway capable of conveying a flow of heated fluid adjacent the carbon-bearing materials through the pyrolyzer furnace housing to fluidize the volatile material therein;

b. burning volatile material and, if desired, other hydrocarbon fuels, in a combustion chamber adjacent the longitudinal pyrolyzer furnace housing, and exhausting combustion fluids through the inner passageway within the hollow drive shaft of the rotatable drive screws and the outer passageway within the pyrolyzer furnace housing; and c. counter rotating the drive screws to cause carbon-bearing material containing volatile materials to move through the longitudinal pyrolyzer furnace housing and be heated to a temperature to fluidize volatile materials herein.

14. The method of making char as claimed in claim 13, further comprising the step of:

transferring fluidized volatile material from the pyrolyzer furnace to the combustion chamber.

15. The method of making char as claimed in claim 13, where the flow of combustion fluids through the inner passageways and outer passageways are in the same direction as the movement of the carbon-bearing materials through the pyrolyzer furnace housing.

16. The method of making char as claimed in claim 13, further comprising the step of:

providing a turbulent flow of combustion fluids through the inner passageway and the outer passageway having a Reynolds Number greater than 4000.

17. The method of making char as claimed in claim 13, further comprising the step of:

tapering outer walls of the hollow shafts of the drive screws to cause the carbon-bearing material to be compressed as it moves through the pyrolyzer furnace housing.

18. The method of making char as claimed in claim 13, further comprising the step of:

reducing the cross sectional area of the portion of the pyrolyzer furnace housing through which carbon-bearing material moves in the direction of movement of the carbon-bearing material through the housing to compress the carbon-bearing material as it moves through the pyrolyzer furnace housing.

19. The method of making char as claimed in claim 13, further comprising the step of:

rotating at least a portion of the pyrolyzer furnace housing around the drive screws while rotating the drive screws to convey carbon-bearing materials through the pyrolyzer furnace housing.

20. The method of making char as claimed in claim 13, further comprising the step of:

heating the volatile materials in the carbon-bearing material to a temperature within a range of approximately 650° F. to 1300° F.

21. The method of making char as claimed in claim 13, further comprising the step of:

raising an end of the pyrolyzer furnace housing to provide a variable elevation in the direction of travel of the carbon-bearing material through the pyrolyzer furnace housing.

22. The method of making char as claimed in claim 13, further comprising the step of:

providing at least three drive screws laterally positioned within the pyrolyzer furnace housing, with each drive screw being positioned such that each screw overlaps at least one other drive screw.

23. The method of making char as claimed in claim 13, comprising the additional steps of:

providing a first zone and a second zone in the pyrolyzer furnace housing, where the first zone is capable of fluidizing volatile materials, and the second zone is capable of mixing supplemental materials into the carbon-bearing materials, and introducing the supplemental materials into the furnace housing in the second zone.

24. The method of making char as claimed in claim 13, further comprising the step of:

conveying heated fluid through at least one manifold conduit to a selected portion of the outer passageway along the pyrolyzer furnace housing.

* * * * *